US008960136B2

(12) United States Patent
Mott et al.

(10) Patent No.: US 8,960,136 B2
(45) Date of Patent: Feb. 24, 2015

(54) METHOD AND APPARATUS FOR MANAGING AIRFLOW AND POWERTRAIN COOLING

(71) Applicants: Britt D. Mott, Olivet, MI (US); Chad A. McCoige, Charlotte, MI (US)

(72) Inventors: Britt D. Mott, Olivet, MI (US); Chad A. McCoige, Charlotte, MI (US)

(73) Assignee: Spartan Motors, Inc., Charlotte, MI (US)

( * ) Notice: Subject to any disclaimer, the term of this patent is extended or adjusted under 35 U.S.C. 154(b) by 0 days.

(21) Appl. No.: 13/896,014

(22) Filed: May 16, 2013

(65) Prior Publication Data

US 2013/0306006 A1 Nov. 21, 2013

Related U.S. Application Data

(60) Provisional application No. 61/648,343, filed on May 17, 2012.

(51) Int. Cl.

| | |
|---|---|
| ***F02P 7/02*** | (2006.01) |
| ***F01P 11/00*** | (2006.01) |
| ***F01P 5/06*** | (2006.01) |
| ***F01P 11/10*** | (2006.01) |

(52) U.S. Cl.

CPC . *F01P 11/00* (2013.01); *F01P 5/06* (2013.01); *F01P 11/10* (2013.01)

USPC ..... 123/41.49; 123/41.11

(58) Field of Classification Search

CPC ..... F01P 5/06; F01P 11/10; F01P 1/06; F01P 1/00; F01P 2070/50; F01P 7/06

USPC ..... 123/41.49, 41.11, 41.63, 41.65; 180/68.1

See application file for complete search history.

(56) References Cited

U.S. PATENT DOCUMENTS

| | | | | |
|---|---|---|---|---|
| 3,794,001 | A * | 2/1974 | Birch et al. | 123/41.05 |
| 4,414,925 | A * | 11/1983 | Mellin | 123/41.12 |
| 4,979,584 | A | 12/1990 | Charles | |
| 5,495,909 | A | 3/1996 | Charles | |
| 5,522,457 | A * | 6/1996 | Lenz | 165/121 |
| 5,588,482 | A | 12/1996 | Holka | |
| 6,071,078 | A * | 6/2000 | Schlegel et al. | 416/247 R |
| 6,363,892 | B1 * | 4/2002 | Zobel et al. | 123/41.12 |
| 6,523,507 | B2 * | 2/2003 | Schmitz et al. | 123/41.55 |
| 6,832,644 | B2 | 12/2004 | Stauder et al. | |
| 6,871,697 | B2 | 3/2005 | Albright et al. | |
| 7,108,482 | B2 * | 9/2006 | Chapman | 416/185 |
| 7,363,961 | B2 * | 4/2008 | Mori et al. | 165/41 |
| 7,537,072 | B2 | 5/2009 | Sturmon et al. | |
| 7,998,233 | B2 * | 8/2011 | Maeda et al. | 55/385.3 |
| 8,015,954 | B2 | 9/2011 | Kardos | |
| 8,091,624 | B2 | 1/2012 | Kardos et al. | |
| 8,376,884 | B2 * | 2/2013 | Spaggiari | 474/184 |

(Continued)

*Primary Examiner* — Noah Kamen
*Assistant Examiner* — Long T Tran
(74) *Attorney, Agent, or Firm* — Reinhart Boerner Van Deuren P.C.

(57) ABSTRACT

An air flow apparatus and method are provided. The apparatus includes a shroud having a first end for connection to a cooling package, and a second end for connection to a fan ring. The fan ring of the apparatus is configured to mount directly to an engine block and surround a fan of the engine block. The apparatus also includes a duct positioned below the shroud and fan ring. The duct has a first opening that opens to an engine compartment, and a second opening that opens to ambient. A flow path extends between the first and second openings and is arranged to route heated air in proximity to the shroud and fan ring to ambient.

20 Claims, 9 Drawing Sheets

(56) References Cited

U.S. PATENT DOCUMENTS

2008/0264094 A1* 10/2008 Campagna et al. ..... 62/402
2008/0292458 A1* 11/2008 Tani et al. ..... 415/213.1
2013/0209242 A1* 8/2013 Ota et al. ..... 415/185

* cited by examiner

METHOD AND APPARATUS FOR MANAGING AIRFLOW AND POWERTRAIN COOLING

CROSS-REFERENCE TO RELATED PATENT APPLICATIONS

This patent application claims the benefit of U.S. Provisional Patent Application No. 61/648,343, filed May 17, 2012, the entire teachings and disclosure of which are incorporated herein by reference thereto.

FIELD OF THE INVENTION

This invention generally relates to automotive cooling systems, and more particularly to air cooling configurations used to remove heat from an automotive cooling system.

BACKGROUND OF THE INVENTION

Contemporary automotive cooling systems typically employ a plurality of coolant lines which circulate coolant through various portions of a vehicle. The coolant within these lines may be used to draw heat away from the engine, the transmission, or other portions of the vehicle (collectively referred to herein as the powertrain) where it is desirable to maintain a controlled temperature. In basic operation, the coolant draws heat away by heat transfer, wherein the heat of the powertrain is transferred to the coolant, thereby elevating the temperature of the coolant.

Once the coolant has drawn heat away from the powertrain, it is routed to a cooling package which may include a coiled or otherwise arrayed tubing configuration(s) commonly referred to as a radiator. Air is directed over the cooling package to reduce the temperature of the coolant so that it may be recirculated again to continue to draw heat away from the powertrain.

Reducing the temperature of the coolant is critical. If the coolant is not sufficiently cooled, it will not effectively absorb a sufficient amount of heat when recirculated. Such a condition can lead to overheating, seizing, etc. Typically, air is directed over the cooling package by two means, each of which operates to reduce the temperature of the coolant therein. First, when the vehicle is moving, ram air from outside the vehicle is directed over the cooling package. Second, when the vehicle is not moving, or when there is an insufficient amount of ram air to effectively reduce the temperature of the coolant, a fan is utilized to draw air over the cooling package. The fan may be engine driven via a belt or the like, or the fan may be electrically driven.

For certain types of vehicles, efficient fan operation is critical because the vehicle may experience high powertrain loads when stationary, i.e. when there is little to no ram air available. For example, firefighting apparatuses such as pumper trucks typically utilize the engine to drive the pump thereof for pumping a large quantity of water to fight a fire. As such, despite being stationary, the powertrain (particularly the engine) experiences a high load that causes the temperature thereof to elevate. The pumper truck must thus rely entirely on its internal fan for effective operation of its cooling system.

Unfortunately, many contemporary air cooling configurations are highly inefficient. More specifically, the fan in a contemporary cooling system, while typically placed in proximity to the cooling package, tends to draw air over only certain portions thereof and/or draw air over the cooling package unevenly. Such inefficient operation of the fan is due in part to the shape of the fan versus the shape of the cooling package. The cooling package is typically rectangular in shape, while the fan generates an air column that is generally cylindrical. As a result, portions of the cooling package may not be exposed to as much cooling air as other portions of the radiator.

Furthermore, air that is drawn over the cooling package increases in temperature as heat is transferred to the air from the coolant within the coolant package. This heated air has a tendency to remain in proximity to the cooling package, thus increasing the overall temperature of the cooling package and the air circulated therein. This condition can limit the ability of the air that is drawn over the cooling package to absorb a sufficient amount of heat from the cooling package. Indeed, because the engine and cooling package are situated within a generally enclosed engine tunnel, this heated air remains in proximity to the cooling package and increases the overall temperature of the environment within the engine tunnel, thus negatively effecting heat transfer efficiency.

Both of the above scenarios are undesirable as they can lead to insufficient cooling. Previous attempts to avoid the above have led to fan oversizing which gives rise to parasitic power loss of the powertrain given that a sufficiently large amount of energy generated by the power train is used to operate such oversized fans. Further, cost of procurement and operation are driven up given that the aforementioned oversized fans can be expensive. Therefore, there is a need in the art for a method and apparatus that will efficiently manage air flow used for powertrain cooling to avoid the above problems.

The invention provides such a system and method. These and other advantages of the invention, as well as additional inventive features, will be apparent from the description of the invention provided herein.

BRIEF SUMMARY OF THE INVENTION

In one aspect, the invention provides an improved air flow apparatus that advantageously directs cooling air drawn by a fan of a cooling system over a greater portion of a cooling package in a more evenly distributed manner than prior designs. An embodiment of this aspect includes a shroud that is mounted at one end to a cooling package, and at the other end to a fan ring of a cooling fan. The shroud operates to evenly distribute a low pressure field generated by the fan over a generally rectangular surface area of the cooling package. Such a configuration ensures that a cooling air is more evenly distributed over the entirety of the cooling package.

More particularly, an embodiment of an air flow apparatus according to this aspect includes a shroud defining a longitudinal axis and having a generally rectangular opening at a first end, and a generally circular opening at a second end. A fan ring is centered on the longitudinal axis and connected at a first end thereof to the second end of the shroud such that the circular opening opens to the fan ring. The shroud and fan ring are arranged to direct a flow of air through the shroud from the rectangular opening to the circular opening thereof, and through the fan ring. A duct is positioned below the shroud and the fan ring for routing air that has passed through the fan ring from the shroud away from the shroud and the fan ring.

In certain embodiments, the shroud has a generally rectangular radially outwardly extending flange adjacent the first opening configured for axially mounting the shroud to a generally rectangular face of the cooling package. Two opposed side edges of the generally rectangular opening are not entirely parallel. The radially extending flange includes a plurality of mounting apertures for axially mounting the shroud.

In certain embodiments, the shroud further comprises a transition region extending from the radially outwardly extending flange, and a sealing lip extending from the transition region. The transition region is defined by a smooth contoured surface that reduces in cross-sectional area when moving along the longitudinal axis from the first end to the second end. The sealing lip includes a radially outwardly facing mounting surface for mounting with the first end of the fan ring in a lap joint configuration. The sealing lip may be a separately formed component fixedly connected to an end of the transition region in a lap joint configuration.

In another aspect, the invention provides an improved air flow apparatus that advantageously removes heated air away from the cooling package so that new cooling air entering the cooling package is not prematurely heated by the heated air and/or so that the ambient temperature around the cooling package is minimized. An embodiment of this aspect includes a duct that is positioned in proximity to the cooling package and to a cooling fan. The duct is open-sided and includes an opening to ambient at one end thereof. The duct thus establishes a flow path extending from an engine compartment containing the cooling package to ambient for the routing of heated air that would otherwise stagnate in proximity to the cooling package.

More particularly, an embodiment of an air flow apparatus according to this aspect includes a shroud defining a longitudinal axis and extending between first and second ends thereof. A fan ring is centered on the longitudinal axis and connected at a first end thereof to the second end of the shroud. The fan ring includes a sealing ring defining the first end of the fan ring. The sealing ring includes a radially inwardly facing mounting surface which circumferentially surrounds and overlaps the second end of the shroud. The shroud and fan ring are arranged to direct a flow of air through the shroud from the first end to the second end thereof, and through the fan ring. A duct is positioned below the shroud and the fan ring for routing air that has passed through the fan ring from the shroud away from the shroud and the fan ring.

In certain embodiments, the sealing ring is a separately formed component from a remainder of the fan ring. The sealing ring is removably secured to a mounting ring of the fan ring. In a subsidiary embodiment, the sealing ring is removably secured to the mounting ring of the fan ring by way of a snap fit connection. The sealing ring includes a radially inwardly facing groove, and the mounting ring includes a radially outwardly facing projection which is received by the radially inwardly facing groove of the sealing ring to achieve the snap fit connection.

In certain embodiments, the fan ring can include at least one axially and radially extending shield which extends from a mounting ring of the fan ring. The at least one shield includes a plurality of shields intermittently arranged around the circumference of the mounting ring of the fan ring.

In yet another aspect, the invention provides an improved air flow apparatus that advantageously maximizes fan efficiency, thereby allowing implementation of smaller fans. An embodiment of this aspect includes an engine mounted fan ring. The spatial orientation and location of the fan ring is accurately governed by way of the aforementioned engine mounting. This accurate location of the fan ring permits a sufficiently low fan blade tip to fan ring clearance that provides for greater air flow than contemporary fan configurations. As a result, smaller fans can be utilized to draw a sufficient amount of cooling air.

More particularly, an embodiment of an air flow apparatus according to this aspect includes a shroud defining a longitudinal axis and extending between first and second ends thereof. A fan ring is centered on the longitudinal axis and connected at a first end thereof to the second end of the shroud. The shroud and fan ring are arranged to direct a flow of air through the shroud from the first end to the second end thereof, and through the fan ring. A duct is positioned below the shroud and the fan ring for routing air that has passed through the fan ring from the shroud away from the shroud and the fan ring. The duct includes a bottom wall and opposed sidewalls extending upwardly from the bottom wall, a front wall extending between the opposed sidewalls and upwardly from the bottom such that the duct has an open top and an open end. The open top serves as an inlet for the flow of air routed from the shroud and fan ring and the open end serves as an outlet for the flow of air, the outlet opening to ambient environment.

In certain embodiments, the bottom wall includes a at least one drain port passing therethrough. In certain embodiments, a seal member is positioned within the duct and extending between the opposed sidewalls and upwardly from the bottom wall. The seal member is configured for sealing against a bottom surface of the cooling package so that air is prevented from circumventing the shroud and fan ring when entering the duct.

In certain embodiments, the shroud and fan ring are sealingly connected to one another, and the shroud is sealingly connected to a face of the cooling package so as to define a flow path for the flow of air entering the duct. In certain embodiments, each of the shroud and fan ring are multi-piece components.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
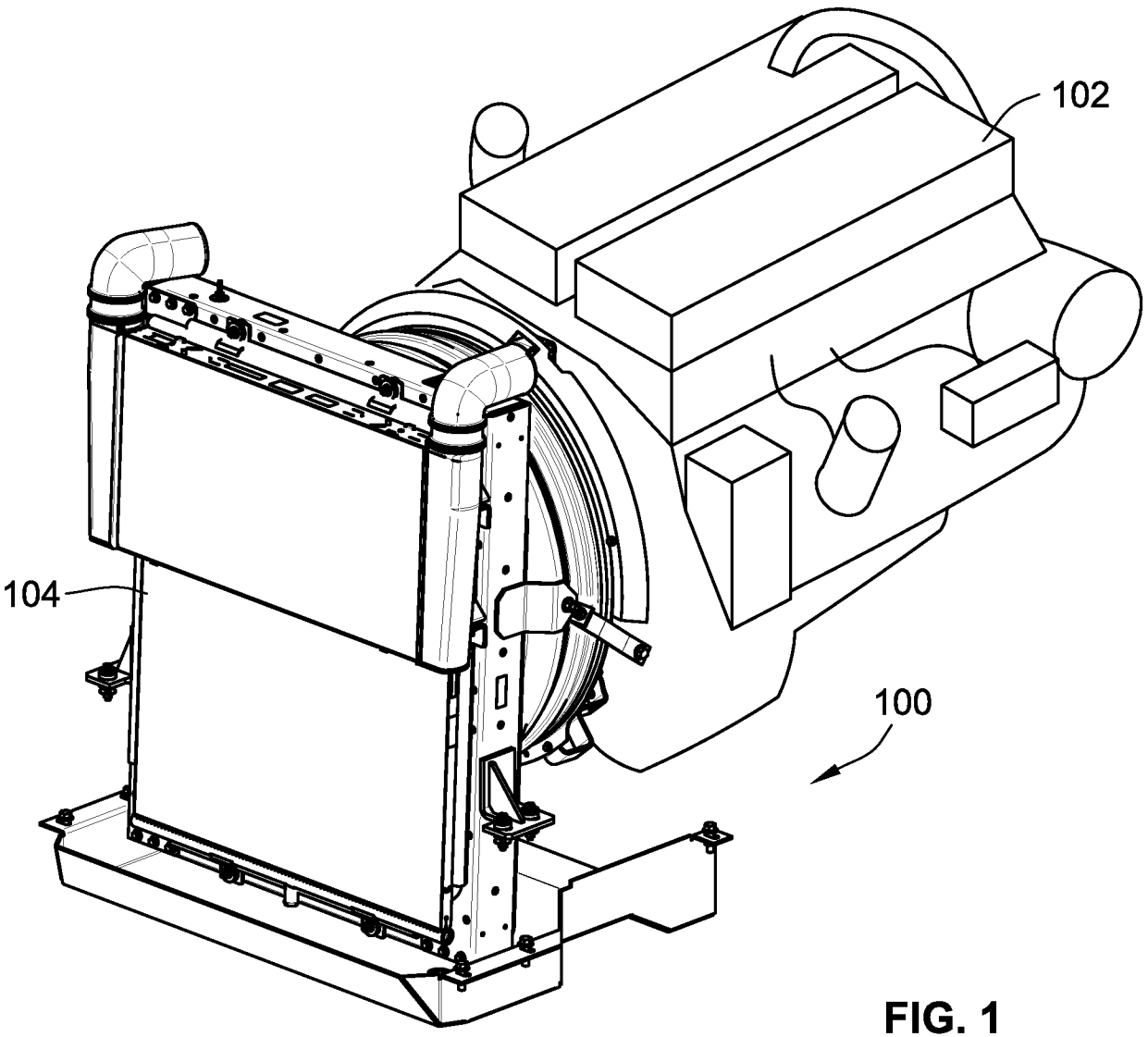
FIG. 1 is a perspective view an embodiment of an air flow apparatus according to the teachings of the present invention.

Turning now to the drawings, an air flow apparatus and method are described herein which efficiently manage air flow for powertrain cooling. With particular reference to FIG. 1, an embodiment of such an air flow apparatus 100 is illustrated. The air flow apparatus 100 shown in FIG. 1 is illustrated mounted generally between and/or in proximity to an engine 102 and a cooling package 104 of a vehicle (not shown). The air flow apparatus 100, engine 102, and cooling package 104 are situated within a generally enclosed engine tunnel of the vehicle. As is understood by those skilled in the art, a typical engine tunnel or compartment surrounds an engine and cooling package, and may incorporate one or more openings to the ambient environment, typically at an underside of the engine tunnel. As will be explained in greater detail in the following, air flow apparatus 100 functions to efficiently and advantageously route heated air through the engine tunnel after it has been utilized by the cooling package to transfer heat therefrom. From the description herein, it will be recognized that the air flow apparatus 100 may be incorporated into any vehicle, and as such, the particular engine 102 and cooling package 104 illustrated should be taken by way of example and not limitation.

Figure 2:
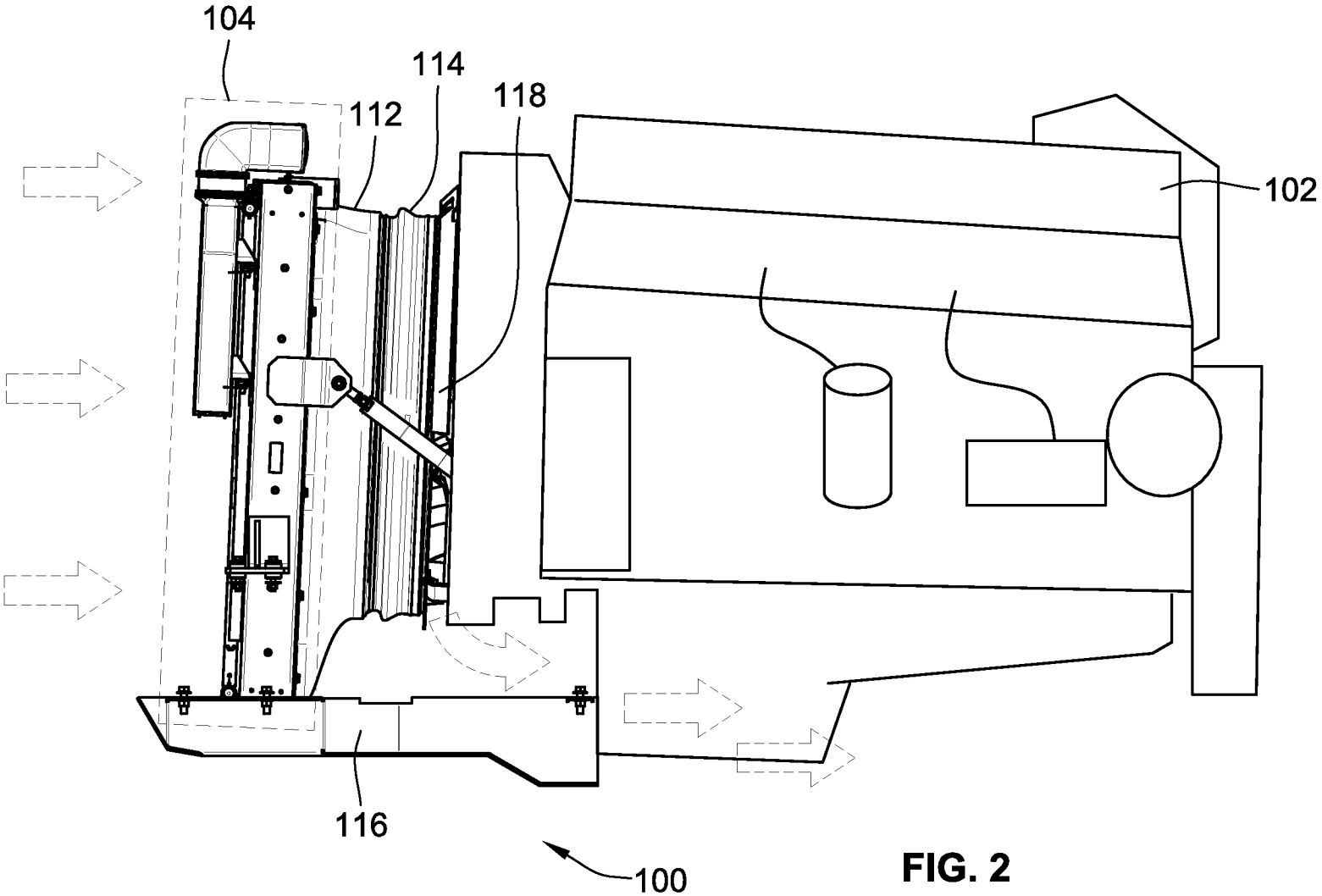
FIG. 2 is a side view of the air flow apparatus of FIG. 1.

Turning now to FIG. 2, air flow apparatus 100 includes a shroud 112, a fan ring 114, and a duct 116. To be described in greater detail below, fan ring 114 surrounds an engine fan 118 (See also FIG. 3). Fan 118 is operable to draw air across cooling package 104 as generally illustrated by the left most air flow arrows in FIG. 2. Shroud 112 is connected at one end to fan ring 114 and at another end to cooling package 104. As will be described in greater detail below, shroud 112 is designed to provide a uniform air flow through cooling package 104 by reducing restriction and providing a smooth transition from the generally rectangular-shaped cooling package 104 to the circular engine fan ring 114. Put differently, shroud 112 operates to transition the generally circular pressure field distribution generated by engine fan 118 to a rectangular pressure field distribution across the right most face of cooling package 104 so that cooling air is evenly distributed across cooling package 104 as it is drawn by engine fan 118.

Fan ring 114 is engine mounted to engine 102 to allow for a tight fan 118 tip clearance to fan ring 114 which results in an increased air flow through the system. Duct 116 is positioned below cooling package 104, shroud 112, and fan ring 114 and provides an open top as well as an open end which define in part a flow path for heated air to travel along once it has been drawn in by fan 118 across cooling package 104 and served its cooling function. Specifically, duct 116 functions to provide a pathway for heated air to exit the area surrounding cooling package 104 so that the same does not inhibit the efficient cooling thereof. Such functionality is additionally illustrated at FIG. 3, where heated air is illustrated being directed into duct 116 and away from cooling package 104 through the open end of duct 116.

Figure 3:
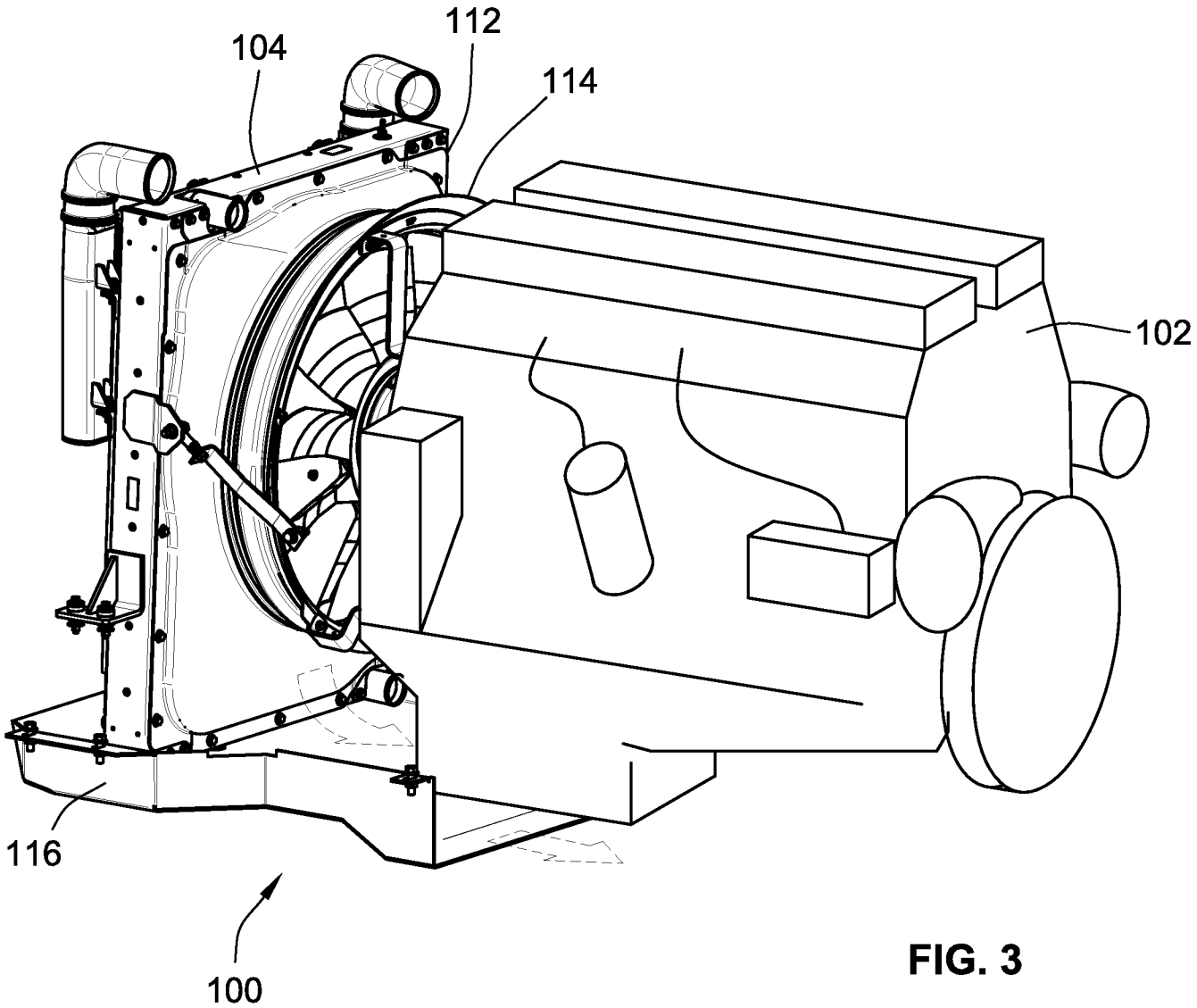
FIG. 3 is a side perspective view of the air flow apparatus of FIG. 1.
Figure 4:
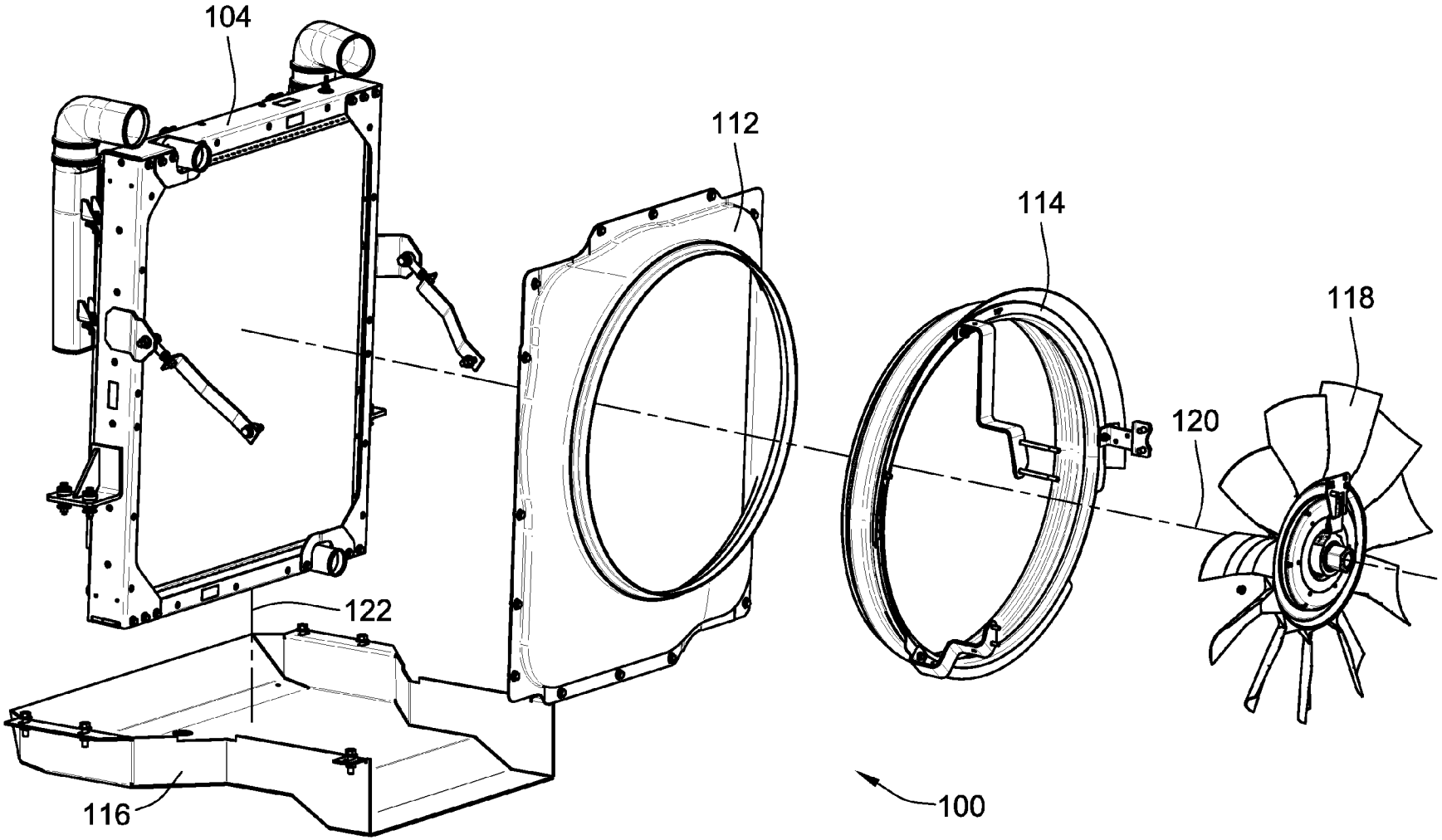
FIG. 4 is an exploded view of the air flow apparatus of FIG. 1 in the context of a cooling fan and cooling package.

Turning now to FIG. 4, air flow apparatus 100 is illustrated in an exploded view relative to cooling package 104 and engine fan 118. Engine 102 is not shown in this view for purposes of clarity. As illustrated, shroud 112 and fan ring 114 are arranged along longitudinal axis 120 that in one sense represents the axis along which air is drawn across cooling package 104 as illustrated in FIGS. 2 and 3. Duct 116 is centered about axis 122 passing generally through the center of cooling package 104. As discussed above, fan ring 114 mounts to engine 102 (See FIGS. 1-3). Shroud 112 mounts to fan ring 114 at one end, and at another end, mounts to cooling package 104. Which such a configuration, an enclosed air flow chamber is defined by the interior surfaces of shroud 112 and fan ring 114 and is arranged along axis 120.

Figure 5:
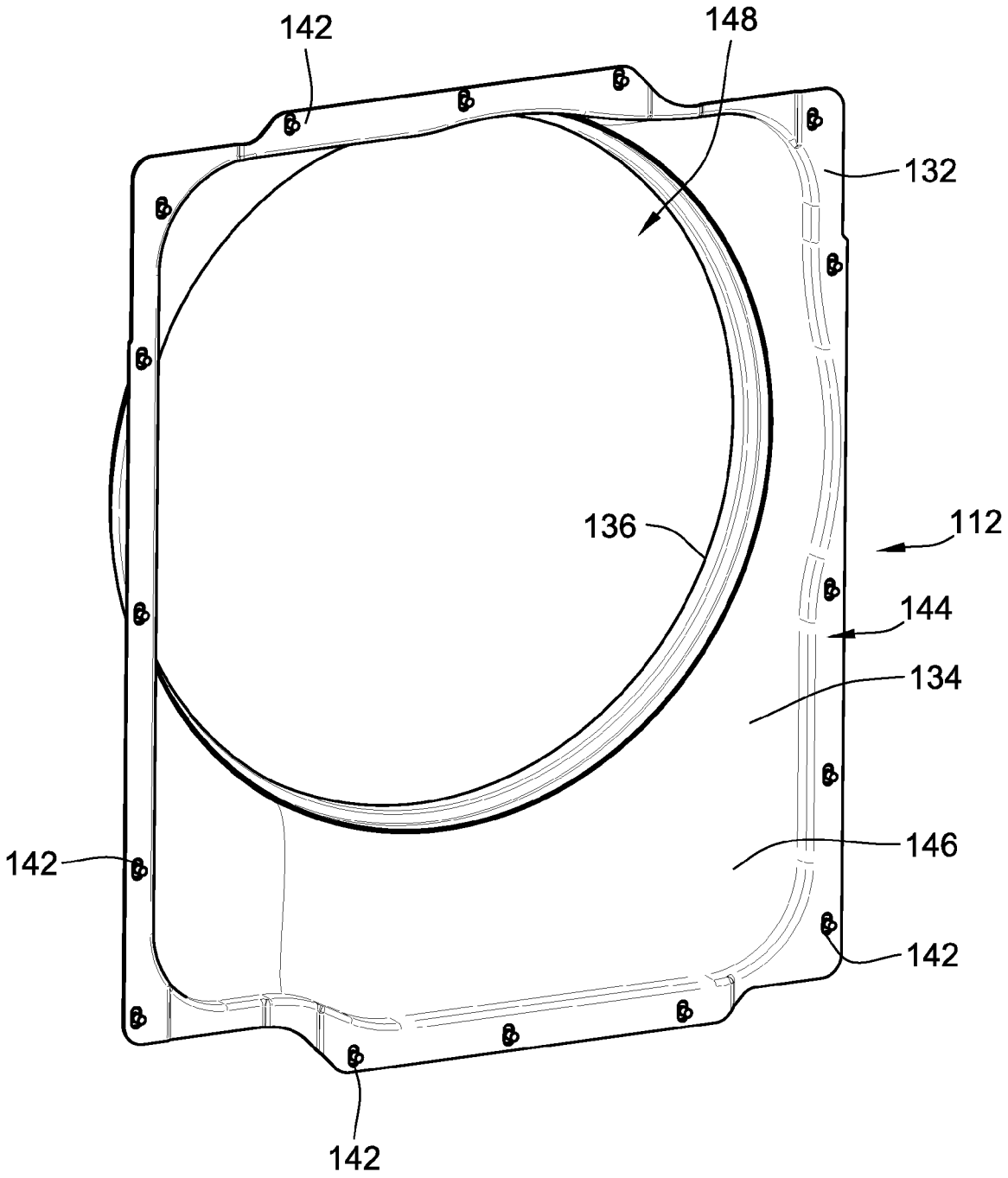
FIG. 5 is a front perspective view of a shroud of the air flow apparatus of FIG. 1.

Turning now to FIG. 5, shroud 112 will be discussed in greater detail. Shroud 112 includes a mounting flange portion 132, a contoured transition portion 134 extending from mounting flange portion 132, and a sealing lip portion 136 extending from transition portion 134. Mounting flange portion 132 is generally normal to axis 120 (See FIG. 4) and mounts to cooling package 104 (See FIG. 4) in a surface or face-style mount. Mounting flange portion 132 includes a plurality of apertures 142 used for mounting shroud 112 to cooling package 104. Mounting flange 132 forms an edge with transition portion 134 to define a generally rectangular opening 144. As illustrated, rectangular opening 144 is not perfectly rectangular to ensure that little to no flow restriction is caused by shroud 112. More specifically, generally rectangular opening 144 has slight curves therealong to ensure that the column of air generated by fan 118 (See FIG. 4) is not inhibited any way at the junction between shroud 112 and cooling package 104 (See FIG. 4).

Transition portion 134 defines a smooth contoured surface 146 that operates to smoothly transition the generally rectangularly-shaped air flow pattern exiting cooling package 104 and moving along axis 120 towards the circular-shaped fan ring 114 (See FIG. 4). Contoured surface 146 is thus generally funnel-shaped as it moves from mounting flange portion 132 towards sealing lip portion 136. Sealing lip portion 136 is circular in shape and provides a sealing surface which contacts fan ring 114 (See FIG. 4) as described below.

Shroud 112 may be manufactured via molding, and may be formed as a single component or as a multi-piece component. As will be described in greater detail below, the particular embodiment of shroud 112 illustrated is a multi-piece component wherein mounting flange portion 132 and transition portion 134 form a single component while sealing lip portion 136 is a separately formed component that is attached to mounting flange portion 132. Shroud 112 and its associated componentry may be manufactured from any structurally rigid material, e.g. metal, plastic, or and/or composites.

Figure 6:
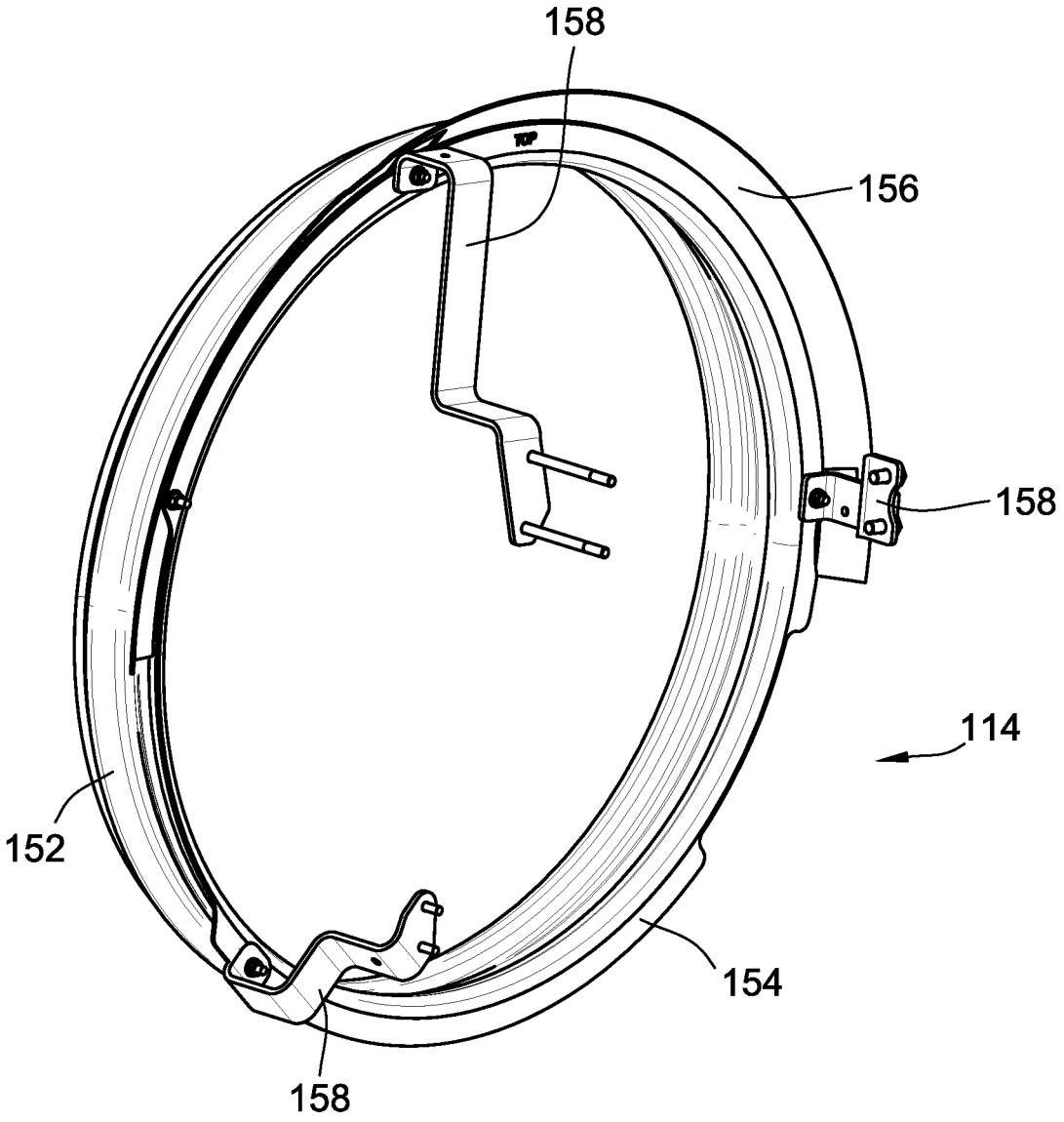
FIG. 6 is a rear perspective view of a fan ring of the air flow apparatus of FIG. 1.

Turning now to FIG. 6, fan ring 114 will be described in greater detail. Fan ring 114 includes a sealing ring 152, a mounting ring 154, and one or more shields 156. Sealing ring 152 provides a sealing surface which mates with a sealing surface of shroud 112 (See FIG. 5) as described in greater detail below. Mounting ring 154 mounts to an end of sealing ring 152 that is opposite the end providing the aforementioned sealing surface. As illustrated, mounting ring 154 includes a plurality of engine mounts 158, which mount fan ring 114 to engine 102 (See FIGS. 1-3). The particular location and shape of engine mounts 158 will vary depending upon the type of engine associated with fan ring 114, and thus the illustrated locations of engine mounts 158 is not in any way limiting on the invention. Engine mounts 158 function to accurately locate fan ring 114 such that a relatively small fan tip to fan ring clearance is provided to ensure that the pressure field generated by engine fan 118 (See FIG. 3) is maximized across the interior of fan ring 114. Shields 156 direct generally radial portions of airflow exiting mounting ring 154 in a more axial and rearward direction. Although a single shield 156 is illustrated, it will be readily recognized that more shields could readily be incorporated without deviation from the invention described herein.

Fan ring 114 is illustrated as a multi-piece component. However, in other embodiments, fan ring 114 could be manufactured such that sealing ring 152 and mounting ring 154 are formed from a single component with engine mounts 158 and shields 156 thereafter attached thereto. Fan ring 114 and its associated componentry may be manufactured from any structurally rigid material, e.g. metal, plastic, or and/or composites.

Figure 7:
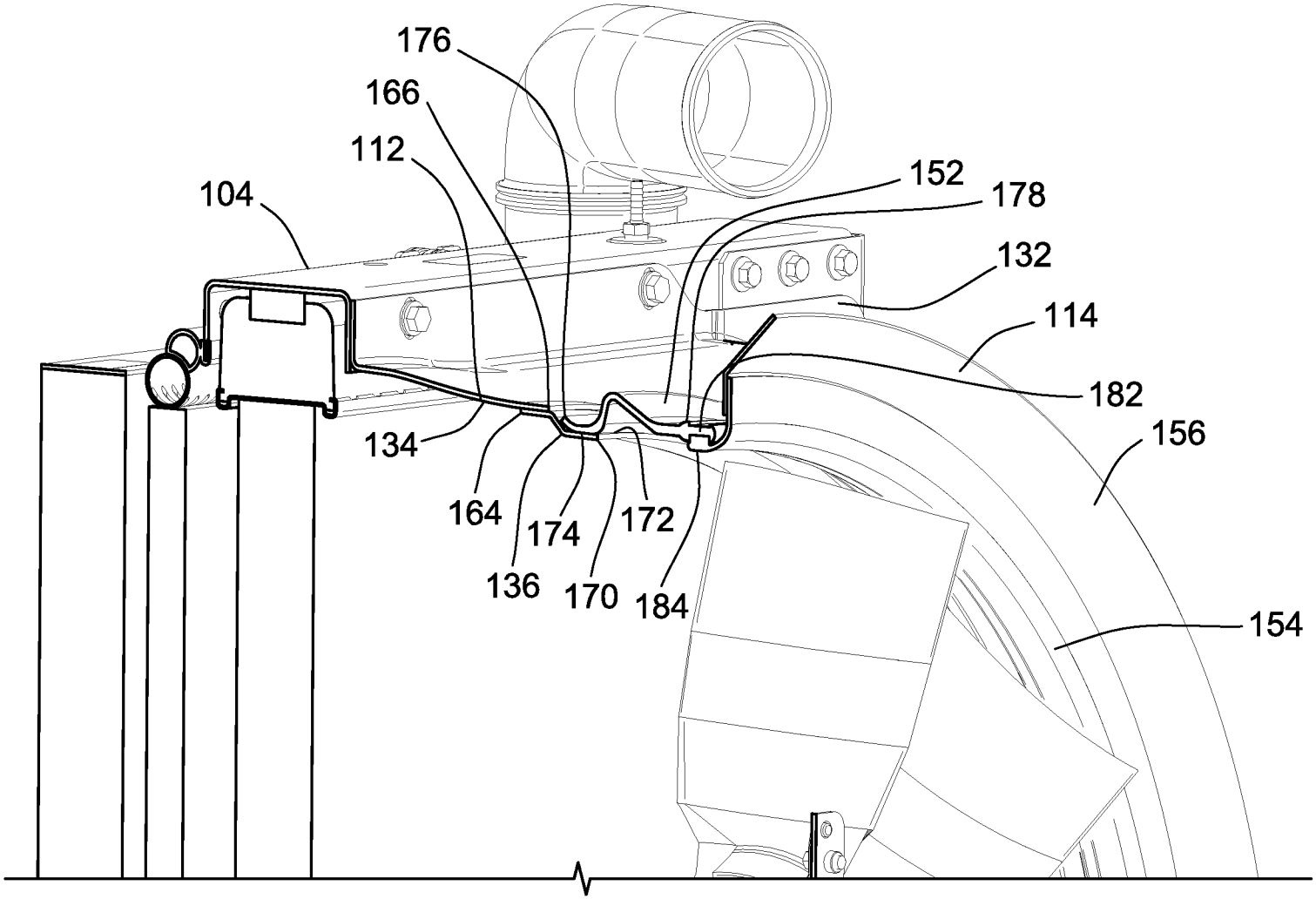
FIG. 7 is a partial perspective cross section of the air flow apparatus of FIG. 1.

Turning now to FIG. 7, the various interfaces of shroud 112 and fan ring 114 are illustrated. As illustrated, mounting flange portion 132 is surface mounted directly to cooling package 104. Transition portion 134 extends from mounting flange portion 132. Sealing lip portion 136 of shroud 112 is affixed at a first end 164 to an end 166 of transition portion 134. As illustrated, first end 164 of sealing lip portion 136 and end 166 of transition portion 134 generally overlap one another. These components may be affixed to one another via bonding, adhesives, or any other mechanical joining process. Additionally, as discussed above, transition portion 134 and sealing lip portion 136 may be formed as a single continuous piece such that the aforementioned lap joint is not present.

A second end 170 of sealing lip portion 136 defines a circumferential contact surface 172 for mating with a circumferential contact surface 174 at a first end 176 of sealing ring 152 in a lap joint configuration. These contact surfaces 172, 174 may be in contact with one another directly, or additional seal material such as adhesives or a gasket may be positioned therebetween. A second end 178 of sealing ring 152 provides a mounting groove 182 for receipt of a radially extending mounting projection 184 of mounting ring 154. Mounting groove 182 may receive mounting projection 184 in a snap-style configuration, or, mounting projection 184 may be secured within mounting groove 182 using adhesives or the like. Additionally, as discussed above, sealing ring 152 and mounting ring 154 may be formed as a single component such that the mounting groove/projection 182, 184 configuration is unnecessary and thus omitted. Shield 156 is mounted to mounting ring 154 via a lap joint as illustrated.

Figure 8:
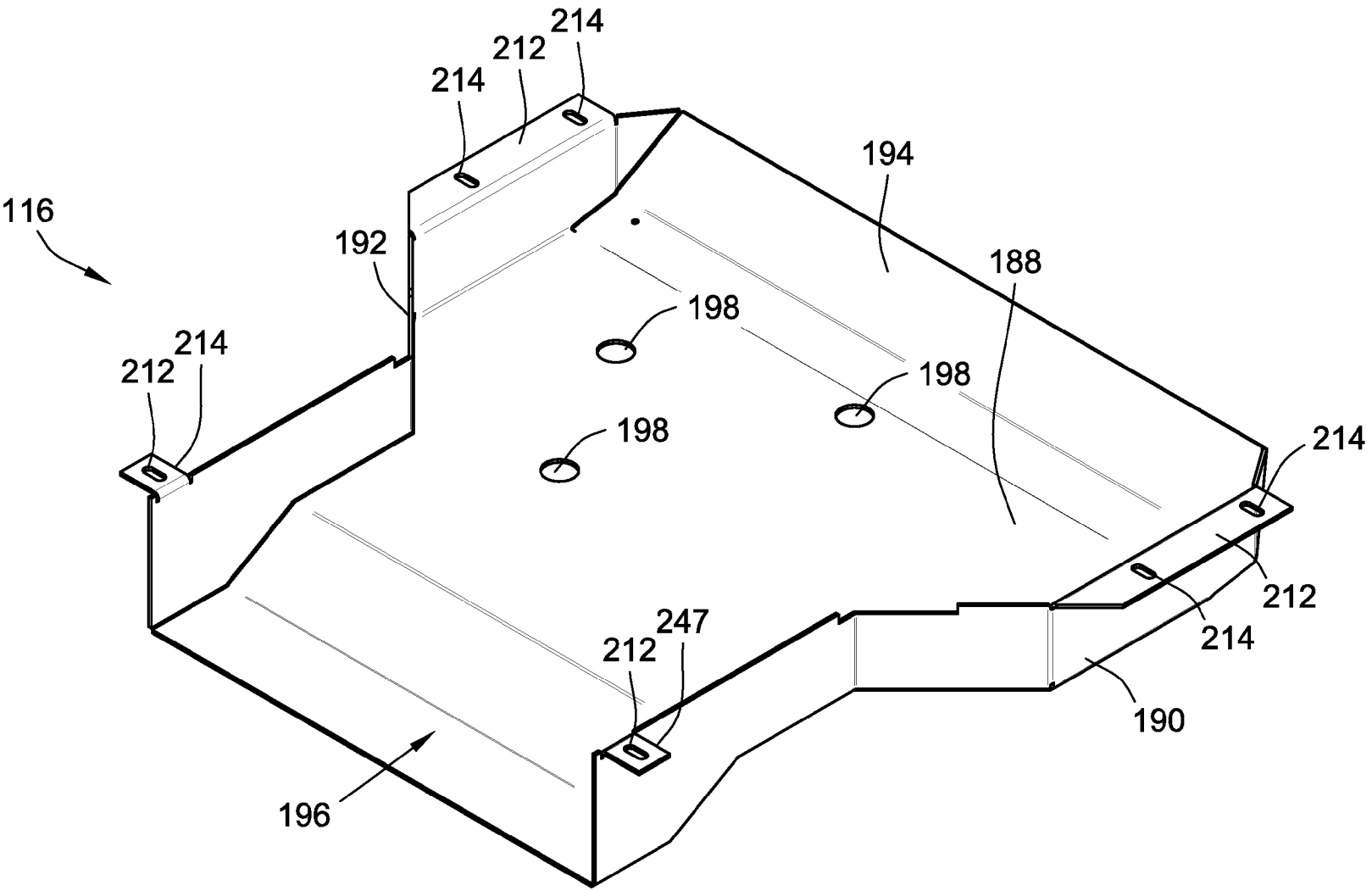
FIG. 8 is a top perspective view of a duct of the air flow apparatus of FIG. 1.

Turning now to FIG. 8, duct 116 will be described in greater detail. Duct 116 has a bottom wall 188, a pair of side walls 190, 192 extending upwardly from bottom wall 188, and a sloped end wall 194 extending upwardly from bottom wall 188 and between side walls 190, 192. The end of duct 116 opposite end wall 194 defines a duct opening 196.

Several drain apertures 198 are formed through bottom wall 188 to facilitate drainage of any foreign material collected within duct 116. As illustrated, bottom wall 188 is not entirely flat or planar, and instead ramps downwardly proximate opening 196.

Side walls 190, 192 each include mounting flanges 212 projecting outwardly therefrom. Mounting flanges 212 each include mounting apertures 214 which allow for the surface mounting of duct 116 to cooling package 104, engine 102, and/or an interior surface of an engine compartment carrying engine 102 (See FIG. 1).

Figure 9:
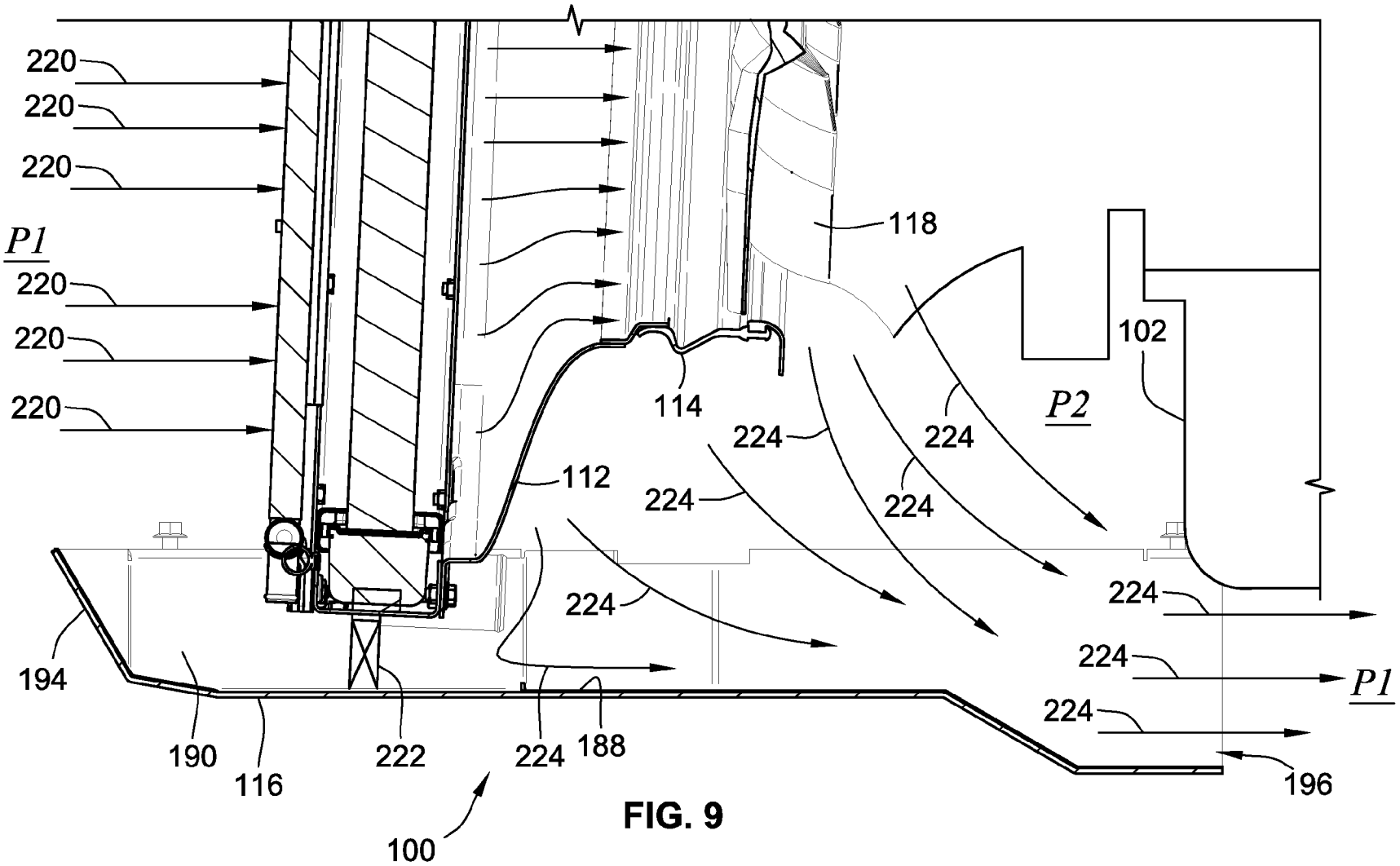
FIG. 9 is a cross section of a lower portion of the air flow apparatus of FIG. 1.

Having discussed the basic structural attributes of an embodiment of duct 116, the flow directional capabilities thereof will be discussed in greater detail now with reference to FIG. 9. A lower portion of air flow apparatus 100 is illustrated at FIG. 9 in cross-section. Air surrounding the left most side of cooling package 104 as well as the exterior of duct 116 is at reference P1. Heated air in proximity to fan 118 and engine 102 within the engine tunnel containing the same is at reference P2 which is greater than reference P1 due to its temperature and limited flow pathways. As such, a pressure differential exists between the areas at pressures P1 and P2.

As fan 118 draws air across cooling package 104 illustrated by flow arrows 220, the same transitions from an area at P1, through cooling package 104, and smoothly through shroud 112 and fan ring 114 towards engine fan 118.

Due to the aforementioned pressure differential as well as the opening 196 formed in the end of duct 116, this air will move out of opening 196 in an attempt to equalize with P1, as generally shown by flow arrows 224. This air is at a greater velocity than the air flow at 220, and as such, is quickly removed from the engine tunnel. As a result, the heated air at P2 which would otherwise stagnate in proximity to cooling package 104 and affect the efficient cooling thereof is rapidly removed from the area surrounding cooling package 104 as well as the engine tunnel containing engine 102. Indeed, opening 196 opens to ambient underneath a vehicle incorporating air flow apparatus 100 and thus operates as a vent port for removing heated air from an engine compartment containing engine 102. A seal 222 is situated between bottom wall 188 of duct 116 and cooling package 104 to prevent air drawn towards cooling package 104 from passing underneath cooling package 104 as opposed to through it, as illustrated. Seal 222 may be formed from any seal material, and may be a gasket, o-ring, or the like. Use of seal 222 generally creates a pressure wall that tends to enhance outbound flow of heated air through opening 196. Furthermore, the length of duct 116 or distance between end wall 194 and opening 196 is sufficiently long enough to prevent heated air from recirculating into the area surrounding cooling package 104.

In view of the foregoing, the embodiment of an air flow apparatus described herein advantageously allows for a downsizing in engine fan requirements due to the optimized air flow between fan 118 and cooling package 104. Furthermore, air flow apparatus 100, in part by way of duct 116, allows for the efficient removal of heated air surrounding cooling package 104 to ensure optimum cooling system operation.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An air flow apparatus for a cooling package of a vehicle, the air flow apparatus comprising:

a shroud defining a longitudinal axis and having a generally rectangular opening at a first end, and a generally circular opening at a second end;

a fan ring centered on the longitudinal axis and connected at a first end thereof to the second end of the shroud such that the circular opening opens to the fan ring;

the shroud and fan ring arranged to direct a flow of air through the shroud from the rectangular opening to the circular opening thereof, and through the fan ring; and an air duct positioned below the shroud and the fan ring for routing air that has passed through the fan ring from the shroud away from the shroud and the fan ring.

2. The air flow apparatus of claim 1, wherein the shroud has a generally rectangular radially outwardly extending flange adjacent the first opening configured for axially mounting the shroud to a generally rectangular face of the cooling package.

3. The air flow apparatus of claim 2, wherein two opposed side edges of the generally rectangular opening are not entirely parallel.

4. The air flow apparatus of claim 3, wherein the radially extending flange includes a plurality of mounting apertures for axially mounting the shroud.

5. The air flow apparatus of claim 2, wherein the shroud further comprises a transition region extending from the radially outwardly extending flange, and a sealing lip extending from the transition region.

6. The air flow apparatus of claim 5, wherein the transition region is defined by a smooth contoured surface that reduces in cross-sectional area when moving along the longitudinal axis from the first end to the second end.

7. The air flow apparatus of claim 6, wherein the sealing lip includes a radially outwardly facing mounting surface for mounting with the first end of the fan ring in a lap joint configuration.

8. The air flow apparatus of claim 7, wherein the sealing lip is a separately formed component fixedly connected to an end of the transition region in a lap joint configuration.

9. An air flow apparatus for a cooling package of a vehicle, the air flow apparatus comprising:

a shroud defining a longitudinal axis and extending between first and second ends thereof;

a fan ring centered on the longitudinal axis and connected at a first end thereof to the second end of the shroud, the fan ring including a sealing ring defining the first end of the fan ring, the sealing ring including a radially inwardly facing mounting surface which circumferentially surrounds and overlaps the second end of the shroud;

the shroud and fan ring arranged to direct a flow of air through the shroud from the first end to the second end thereof, and through the fan ring; and an air duct positioned below the shroud and the fan ring for routing air that has passed through the fan ring from the shroud away from the shroud and the fan ring.

10. The air flow apparatus of claim 9, wherein the sealing ring is a separately formed component from a remainder of the fan ring.

11. The air flow apparatus of claim 10, wherein the sealing ring is removably secured to a mounting ring of the fan ring.

12. The air flow apparatus of claim 11, wherein the sealing ring is removably secured to the mounting ring of the fan ring by way of a snap fit connection.

13. The air flow apparatus of claim 12, wherein the sealing ring includes a radially inwardly facing groove, and the mounting ring includes a radially outwardly facing projection which is received by the radially inwardly facing groove of the sealing ring to achieve the snap fit connection.

14. The air flow apparatus of claim 9, wherein the fan ring includes at least one axially and radially extending shield which extends from a mounting ring of the fan ring.

15. The air flow apparatus of claim 14, wherein the at least one shield includes a plurality of shield intermittently arranged around the circumference of the mounting ring of the fan ring.

16. An air flow apparatus for a cooling package of a vehicle, the air flow apparatus comprising:

a shroud defining a longitudinal axis and extending between first and second ends thereof;

a fan ring centered on the longitudinal axis and connected at a first end thereof to the second end of the shroud;

the shroud and fan ring arranged to direct a flow of air through the shroud from the first end to the second end thereof, and through the fan ring; and an air duct positioned below the shroud and the fan ring for routing air that has passed through the fan ring from the shroud away from the shroud and the fan ring, the duct including a bottom wall and opposed sidewalls extending upwardly from the bottom wall, a front wall extending between the opposed sidewalls and upwardly from the bottom such that the duct has an open top and an open end, wherein the open top serves as an inlet for the flow of air routed from the shroud and fan ring and the open end serves as an outlet for the flow of air, the outlet opening to ambient environment.

17. The air flow apparatus of claim 16, wherein shroud and fan ring are sealingly connected to one another and wherein the shroud is sealingly connected to a face of the cooling package so as to define a flow path for the flow of air entering the duct.

18. The air flow apparatus of claim 17, wherein each of the shroud and fan ring are multi-piece components.

19. An air flow apparatus for a cooling package of a vehicle, the air flow apparatus comprising:

a shroud defining a longitudinal axis and extending between first and second ends thereof;

a fan ring centered on the longitudinal axis and connected at a first end thereof to the second end of the shroud;

the shroud and fan ring arranged to direct a flow of air through the shroud from the first end to the second end thereof, and through the fan ring; and a duct positioned below the shroud and the fan ring for routing air that has passed through the fan ring from the shroud away from the shroud and the fan ring, the duct including a bottom wall and opposed sidewalls extending upwardly from the bottom wall, a front wall extending between the opposed sidewalls and upwardly from the bottom such that the duct has an open top and an open end, wherein the open top serves as an inlet for the flow of air routed from the shroud and fan ring and the open end serves as an outlet for the flow of air, the outlet opening to ambient environment; and wherein the bottom wall includes a at least one drain port passing therethrough.

20. The air flow apparatus of claim 19, further comprising a seal member positioned within the duct and extending between the opposed sidewalls and upwardly from the bottom wall, the seal member configured for sealing against a bottom surface of the cooling package so that air is prevented from circumventing the shroud and fan ring when entering the duct.

* * * * *